US006044238A

United States Patent [19]

Rodriguez

[11] Patent Number: 6,044,238

[45] Date of Patent: Mar. 28, 2000

[54] REPLACEMENT SEAL ASSEMBLY FOR A TONER CARTRIDGE

[75] Inventor: Philip C. Rodriguez, Palmdale, Calif.

[73] Assignee: Nu-kote International, Inc., Franklin, Tenn.

[21] Appl. No.: 09/173,648

[22] Filed: Oct. 16, 1998

Related U.S. Application Data

[60] Provisional application No. 60/063,482, Oct. 17, 1997.

[51] Int. Cl.[7] ..... G03G 15/08

[52] U.S. Cl. ..... 399/106; 399/119

[58] Field of Search ..... 399/105, 106, 399/102, 103, 119, 262; 222/DIG. 1

[56] References Cited

U.S. PATENT DOCUMENTS

| | | | |
|---|---|---|---|
| 4,732,277 | 3/1988 | Smith . | |
| 5,150,807 | 9/1992 | Seyfried et al. . | |
| 5,177,540 | 1/1993 | Honda et al. | 399/102 |
| 5,184,182 | 2/1993 | Michlin . | |
| 5,296,902 | 3/1994 | Michlin . | |
| 5,335,831 | 8/1994 | Foster . | |
| 5,370,761 | 12/1994 | Chitouras . | |
| 5,585,902 | 12/1996 | Nishiuwatoko et al. . | |
| 5,621,508 | 4/1997 | McNamara . | |
| 5,724,631 | 3/1998 | Nakao | 399/103 |
| 5,878,306 | 3/1999 | Michlin | 399/106 |

OTHER PUBLICATIONS

3M Technical Data: Silicone/Acrylic Double Coated Film Tape 9731, Jul., 1994.

3M Technical Data: Puncture/Tear Resistant Film 8410 Dec., 1996.

*Primary Examiner*—Richard Moses

*Attorney, Agent, or Firm*—Fay, Sharpe, Fagan, Minnich & McKee, LLP

[57] ABSTRACT

A toner cartridge replacement seal assembly includes a thin film or other substrate which has an aperture formed therein. The aperture is preferably shaped and sized in accordance with the toner discharge opening of the toner cartridge hopper with which it is to be associated or used. A first adhesive is located on a first or upper surface of the substrate, and a release liner seal member, including a leader, is adhered to the upper surface of the substrate in covering relation with the aperture. A second adhesive, with greater adherence than the first adhesive, is located on a second or lower surface of the substrate. A release liner is also adhered to this lower surface. When the release liner is removed from the second, lower surface of the seal assembly, the seal may be bonded to a toner cartridge hopper via the exposed second adhesive in it operative position blocking the toner discharge opening of the cartridge. The adhesive bond between the seal assembly and the hopper via the second adhesive is substantially stronger than the adhesive bond between the release liner seal member and the substrate via the first adhesive. Upon removal of the release liner seal member for implementing use of the toner cartridge, the substrate, along with the first and second adhesives on opposite sides thereof, remains bonded to the hopper. Consequently, the release liner seal member does not adhere to and/or damage any cartridge components during the withdrawal process.

14 Claims, 3 Drawing Sheets

REPLACEMENT SEAL ASSEMBLY FOR A TONER CARTRIDGE

CROSS-REFERENCE TO RELATED APPLICATION

This application claims priority from U.S. provisional application Ser. No. 60/063,482 filed Oct. 17, 1997.

BACKGROUND OF THE INVENTION

The present invention relates generally to the art of toner cartridge recharging. More particularly, it relates to a new and improved toner hopper replacement seal assembly that provides effective and durable toner hopper sealing, is easily removed prior to use of the toner cartridge without damage to gasketing and other essential cartridge components, and which simplifies subsequent recharging of the toner cartridge upon the depletion of toner.

Toner cartridges are well known and are used in laser beam printers, facsimile machines, electrophotographic copying machines, and other such apparatus to form an image on a piece of paper or other suitable image recording media. In such image forming apparatus, a latent image is formed by selectively exposing a rotating photosensitive drum which has been uniformly charged. Toner is then transferred from a toner hopper or tank to the photosensitive drum to form a toner image on the drum. A recording sheet, most commonly paper, is contacted with the drum so that the toner image is transferred to the sheet for viewing. Finally, a wiper blade contacts the drum and removes any excess toner so that another latent image may be formed on the drum.

To prevent the flow of toner from the toner hopper during shipping, handling, and installation of the toner cartridge, a seal member is positioned over the toner discharge opening in covering relation therewith. Typically, the seal member is disposed in sealing engagement with the hopper through use of an adhesive vehicle or the equivalent. A leader is connected to the seal and extends outwardly from the cartridge through a seal removal slot or opening located between the hopper and an associated magnetic roller or housing. Immediately prior to or following insertion of the toner cartridge into an image forming apparatus, the leader is pulled outwardly relative to the cartridge so that, in turn, the seal member itself is pulled away from the toner discharge opening and out of the cartridge. Depending upon the type of cartridge involved, the overall seal assembly may include a gasket member that remains in the cartridge to inhibit toner leakage between the hopper and the interconnected magnetic roller housing.

It is well known to recharge toner cartridges with toner upon the depletion of the toner from the toner supply hopper. In one type of recharging process, the hopper is separated from the magnetic roller housing. The toner discharge opening is then resealed and the hopper refilled with toner. Once reassembled, the toner cartridge is ready for use in an image forming apparatus upon removal of the replacement seal in a like manner to that described above.

Various types of replacement seals are known for resealing the toner discharge opening. One common prior replacement seal comprises a strip of flexible plastic that is positioned over the toner discharge opening and heated in conjunction with the application of pressure so that the seal partially melts and becomes bonded to the toner hopper. While such seals have been found to be effective, the proper positioning, heating, and bonding these seals to the toner hopper is time consuming and requires heating elements and presses which are expensive to build and maintain. Further, the heating elements and presses require trained operators for safe and effective operation. Also, more recent toner cartridge designs and constructions are such that these heat seals are simply unsuitable for hopper resealing applications.

FIGS. 1–3 in the drawings annexed hereto and made a part hereof illustrate another prior replacement seal member A which is adhesively bonded to the toner hopper B in a covering relation with the toner discharge opening C. The seal member A may include a foam or other gasket disposed in surrounding relation to the toner discharge opening. After the seal member A is adhered to the hopper B, a magnetic roller housing D is reconnected to the toner hopper B. A leader E of the seal extends outwardly between the hopper B and the magnetic roller housing D. The magnetic roller housing includes at least first and second foam gaskets F1,F2 to prevent toner leakage between the hopper and the magnetic roller housing after the seal has been removed from the cartridge. As described above, to remove the seal member A prior to use, the leader E is pulled away from the cartridge as indicated by the arrow G (FIG. 3). However, with these prior sealing arrangements, the adhesive H used to bond the seal member A to the hopper B remains at least partially adhered to the seal member itself rather than to the hopper B. As such, and during seal removal as is depicted in FIG. 3, the adhesive H is exposed to the foam gaskets F1,F2. This exposure thus causes the seal member to at least partially adhere to the foam gaskets. Further pulling of the leader E results in the foam gaskets F1,F2 being torn or pulled away from their operative positions thereby rendering them ineffective or certainly less effective in preventing toner leakage.

To combat this problem, one prior adhesive seal is constructed from a fibrous or ribbon-like material that tears very easily in the direction E in which the leader is pulled. In this type of replacement seal, the central portion of the seal member is pulled away from the cartridge while the seal member edges remain adhesively bonded to the hopper. Although this approach adequately prevents the seal member from adhering to the foam gaskets F1,F2, such seals have not been found sufficiently durable. As is illustrated in FIG. 1, ruptures I occur in this type of seal arrangement if the recharged toner cartridge is inadvertently dropped or otherwise roughly handled or mishandled. Also, these seals have been found to be undesirably expensive, and typically include a relatively thick gasket member that may be up to approximately 0.036 inches or more in thickness. This excessive thickness prevents the seal from being used to reseal certain types of cartridges available and used in the marketplace.

Accordingly, it has been considered desirable to develop a replacement seal assembly for sealing a toner hopper discharge opening that is easily installed without complex equipment, is durable, and does not damage foam gaskets or other components of the cartridge as the seal member is pulled from the cartridge.

The subject invention is deemed to meet the foregoing needs and others, and provide a new and improved replacement seal assembly for a toner cartridge that provides better and more advantageous overall results.

SUMMARY OF THE INVENTION

In accordance with a preferred embodiment of the present invention, a toner cartridge replacement seal assembly includes a thin film, paper, or other substrate which has an aperture formed therein. This aperture is preferably shaped and sized in accordance with the toner discharge opening of the toner cartridge hopper with which it is to be associated or used. A first adhesive is located on an upper surface of the substrate, and a release liner seal member, including a leader, is adhered to the upper surface of the substrate in covering relation with the aperture. A second adhesive, having adherence properties greater than those of the first adhesive, is located on the lower surface of the substrate. A release liner is adhered to the substrate lower surface and is removed to expose the second adhesive. The seal assembly is bonded to a toner cartridge hopper via the exposed second adhesive such that the adhesive bond between the seal assembly and the hopper is substantially stronger than the adhesive bond between the release liner seal member and the substrate. When operatively positioned to seal a toner discharge opening, the aperture of the substrate is disposed in registry with the toner discharge opening. As such, the release liner seal member sealingly covers the toner discharge opening. Upon removal of the release liner seal member for implementing use of the toner cartridge, the substrate, along with the first and second adhesives on opposite sides thereof, remains bonded to the hopper. Consequently, the release liner seal member does not adhere to and/or damage any cartridge components during the withdrawal process.

One advantage of the present invention resides in the relative ease of installation of the seal assembly.

Another advantage of the invention is found in the fact that the substrate is more aggressively bonded to the toner hopper than to the release liner seal member for ensuring that the adhesive remains bonded to the toner hopper upon removal of the release liner seal member from the toner cartridge.

Another advantage of the invention is found in the use of a particular seal member that will not rupture upon normal cartridge mishandling.

A further advantage of the present invention is that it is easily removed from a toner cartridge during a subsequent recharging process.

Still other benefits and advantages of the invention will become readily apparent to those skilled in the art upon reading and understanding the following detailed specification.

BRIEF DESCRIPTION OF THE DRAWINGS

The invention may take physical form in certain parts and arrangements of parts, and be carried out in certain steps and arrangements of steps, preferred embodiments of which will be described in detail in this specification and illustrated in the accompanying drawings which form a part hereof and wherein.

DETAILED DESCRIPTION OF THE INVENTION

Referring now to FIGS. 4–7 wherein the showings are for purposes of illustrating a preferred embodiment of the invention only and not for limiting the same, a replacement seal assembly 10 includes a substrate 12 made of a suitable paper or film such as that used in the manufacture of double-sided tape. The substrate 12 has a width W and a length L, each at least slightly greater than the width and length of the toner discharge opening of a toner hopper B with which it will be associated. Furthermore, the substrate includes an aperture 14 that substantially corresponds in size and shape with the toner discharge opening of the hopper B. In this manner, when the seal assembly 10 is adhered to a toner hopper to seal the toner discharge opening, the substrate 12 extends around the periphery of the toner discharge opening. In that adhesively secured or mounted position, and the aperture 14 in the substrate 12 is in at least partial registry with the hopper toner discharge opening.

Figure 1:
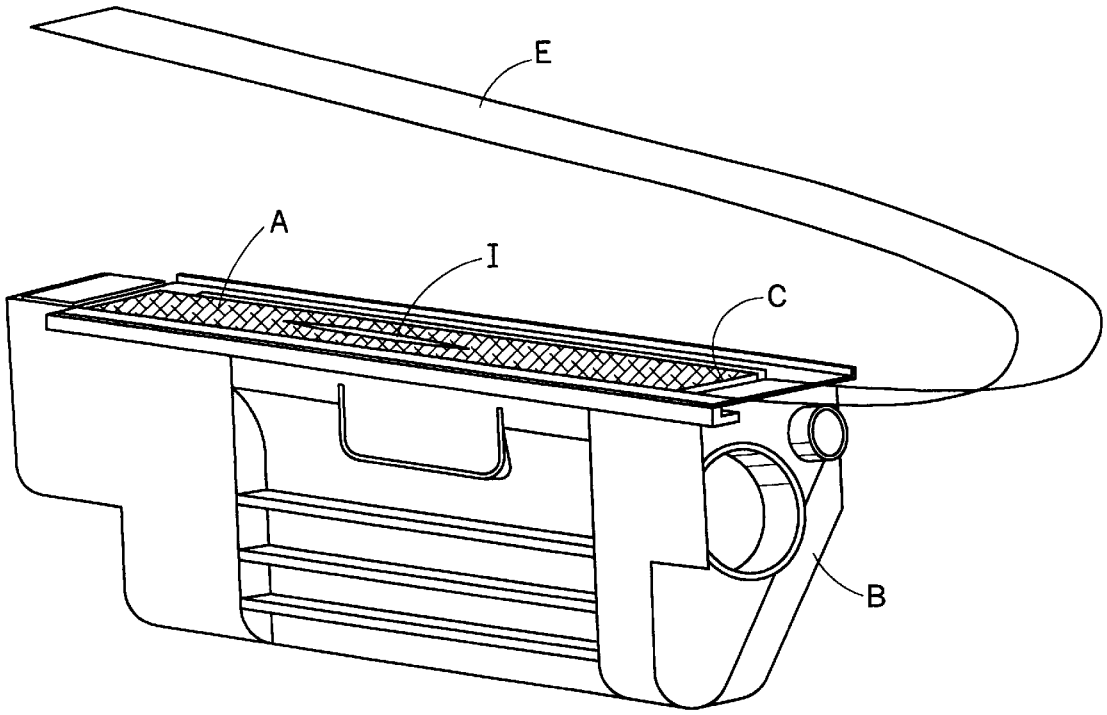
FIG.1 (PRIOR ART)
FIG. 1 is a perspective view of a toner cartridge hopper illustrating a prior seal assembly and resealing method.
Figure 2:
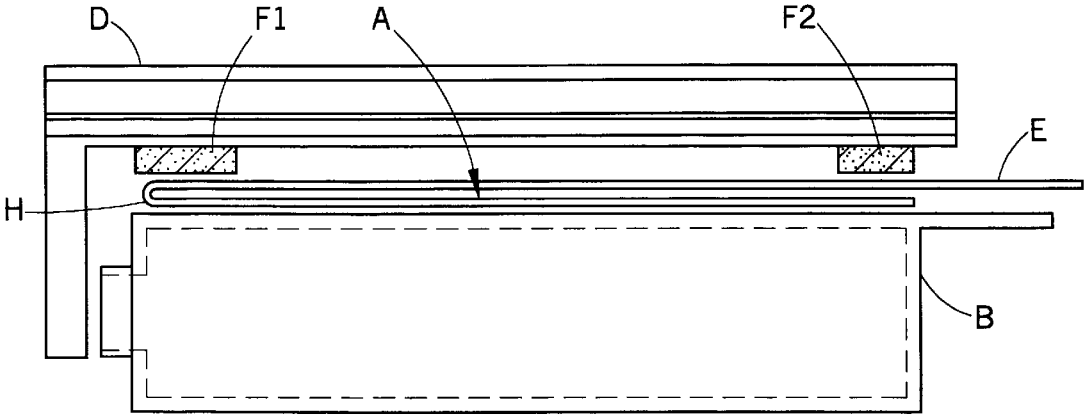
FIG.2 (PRIOR ART)
FIGS. 2–3 are front elevational views of the toner cartridge hopper of FIG. 1 including an associated magnetic roller housing connected thereto.
Figure 3:
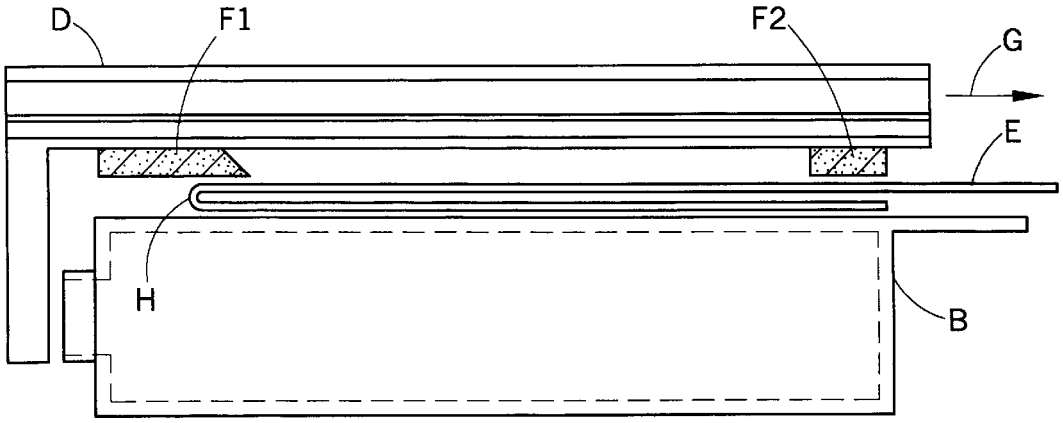
FIG.3 (PRIOR ART)
Figure 4:
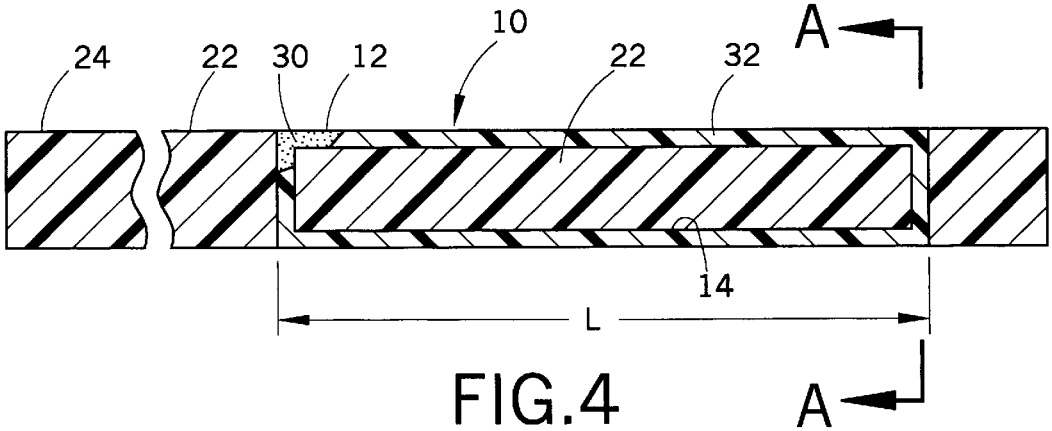
FIG. 4 is a bottom plan view of a replacement seal assembly formed in accordance with the present invention, and with a portion of a release liner broken away for ease of illustration.
Figure 5:
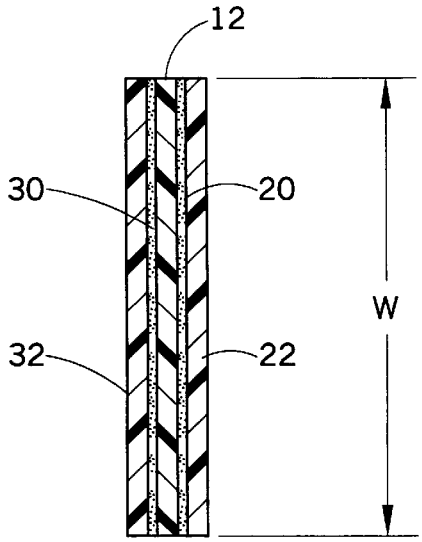
FIG. 5 is a cross-sectional view taken along lines A—A of FIG. 4.

Referring particularly to FIGS. 4 and 5, substrate 12 has a first or upper-face surface which includes a first adhesive 20. This adhesive releasably adheres or secures a release liner seal member 22 to the substrate upper surface. The release liner seal member 22 preferably comprises a puncture and tear resistant material such as, for example, multilayer polyester film, available commercially from Minnesota Mining & Mfg. Co., St. Paul, Minn., 55144 under the trade name 3M 8410 Puncture/Tear Resistant Film. Other suitable materials could, of course, also be used within the spirit and intent of the invention. The release liner seal member 22 sealingly covers the substrate aperture 14 and includes an elongated conventional leader 24 extending therefrom for selective removal of the release liner seal member from the substrate 12 prior to use of the toner cartridge in an image forming apparatus.

A second or lower-face surface of the substrate includes a second adhesive 30 applied thereto. This second adhesive is "stronger" or has greater adhesion properties than those of the first adhesive 20. Preferably, a release liner 32 releasably covers the second adhesive 30 until the seal assembly 10 is to be adhesively secured to toner hopper B in covering relation with a toner discharge opening.

The combination of the substrate 12 having the first adhesive 20 on the upper surface and the second adhesive 30 (having greater adhesion properties than the first adhesive) on the lower surface is available commercially in the form of double-sided tape from Minnesota Mining & Mfg. Co., St. Paul, Minn., 55144 under the trade name 3M 9731 Silicone/Acrylic Double Coated Film Tape. Other tapes and substrates with adhesive surfaces may also be used to advantage without departing from the overall intent or scope of the present invention. The tape may be cut to size and cut to include the toner discharge aperture 14. The preferred double-sided tape is provided from the manufacturer with different colored or types of release liners on the opposite faces or sides thereof (e.g., clear film over the first adhesive 20 and tan paper over the second adhesive 30). This permits a user to distinguish easily between the first and second adhesives.

To manufacture a seal assembly 10, a section of the above-described double-sided tape, including the factory installed release liners, is cut to the desired size and to include the aperture 14. Thereafter, the factory installed release liner over the first adhesive is removed, and the release liner seal member 22 is secured to the exposed adhesive 20. If desired, inspection may be made of the color or other characteristics of the release liner 32 to ensure that the seal member 22 was affixed to the first, weaker adhesive 20, rather than the second, more aggressive adhesive 30.

Figure 6:
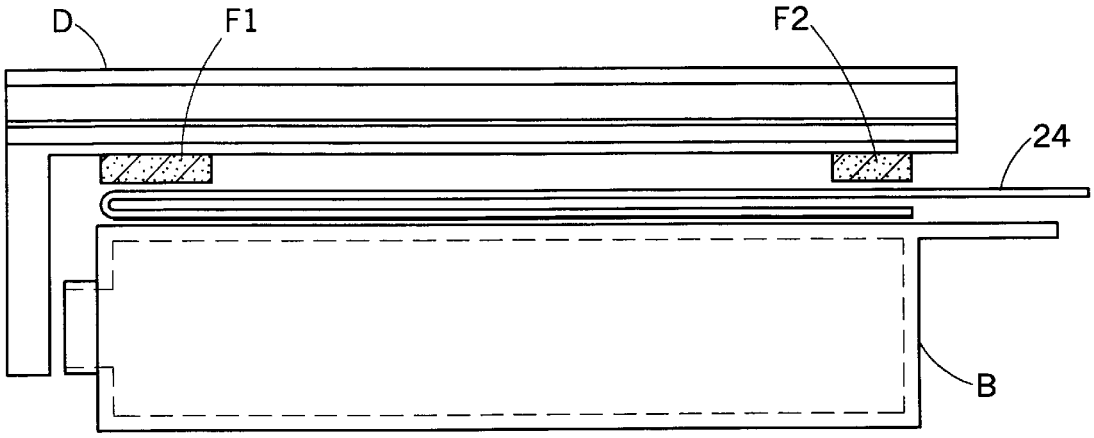
FIG. 6 is a front elevational view of a toner hopper and magnetic roller housing including a replacement seal formed in accordance with the present invention; and, FIG. 7 is a front elevational view similar to FIG. 6 for showing removal of the release liner seal member.
Figure 7:
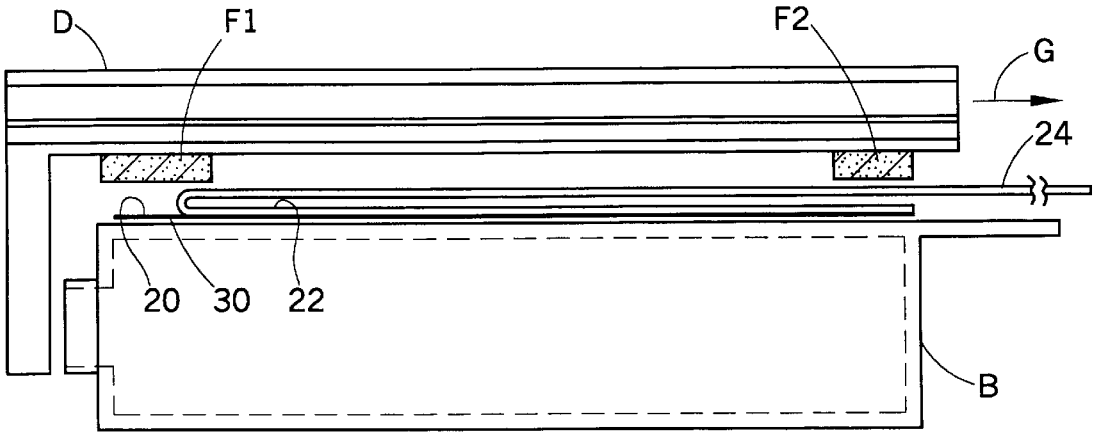

Referring now also to FIGS. 6 and 7, the seal assembly 10 is advantageously used to seal a toner discharge opening of a toner hopper B. More particularly, the release liner 32 is removed to expose the second adhesive 30. The seal assembly 10 is then adhesively bonded via adhesive 30 to the hopper B in a manner such that the aperture 14 is in at least substantial registry with the toner discharge opening. The leader 24 is folded back upon itself to extend from a seal removal space located between the hopper B and the reattached magnetic roller housing D. The seal attachment procedure is preferably carried out by hand and requires no complex heating or pressurizing equipment.

To remove the release liner seal member 22 to prepare the cartridge for use in an image forming apparatus, the leader 24 is pulled in the direction of arrow G. The pulling force on the leader causes the seal member 22 to be peeled away from the substrate and first adhesive 20. As is best shown in FIG. 7, the relatively weak adhesion between the seal member 22 and the adhesive 20, compared to the strong adhesion between the second adhesive 30 and the hopper B, results in the complete separation of the release liner seal member 22 from the first adhesive 20. The structure of this arrangement is such that no adhesive is present or remains on the separated seal member 22. Consequently, although the seal member 22 does contact the foam gaskets F1,F2 during seal member removal, it does not become adhered to the gaskets or to any other components and thereby cause undesired damage thereto. In this manner, when the seal member 22 is completely removed, the gaskets F1,F2 are maintained in good and undisturbed condition to function properly for inhibiting toner leakage between the hopper B and the magnetic roller housing D. Furthermore, a seal assembly formed in accordance with the present invention will have a thickness of only approximately 0.007 inches, and this is significantly thinner than prior seals. Accordingly, the subject invention allows the seal assembly 10 to be used on and in connection with a wide variety of toner hoppers.

During subsequent recharging of the hopper B, and after the magnetic roller housing D is removed, the substrate 12, along with the first and second adhesives applied thereto or coated thereon is easily peeled away from the hopper B. This, then, allows for ready replacement by another seal assembly 10 in accordance with the present invention.

The invention has been described with reference to a preferred embodiment. obviously, modifications and alterations will occur to others upon a reading and understanding of the preceding specification. It is intended that the invention be construed as including all such modifications and alterations insofar as they fall within the scope of the appended claims or equivalents thereof.

Having thus described the preferred embodiments, the invention is claimed to be:

1. A toner cartridge replacement seal assembly comprising:

a thin-filmed substrate including an aperture therein, said substrate having first and second opposite faces;

a first adhesive on the first face, said first adhesive having a first adhesion strength;

a second adhesive on the second face, said second adhesive having a second adhesion strength greater than the first adhesion strength;

a release liner seal member adhered to the first face of the substrate by the first adhesive, said release liner seal member including an elongated leader freely extending therefrom; and a release liner adhered to the second face of the substrate by the second adhesive.

2. The toner cartridge replacement seal assembly as set forth in claim 1 wherein said first adhesive comprises a silicone adhesive and wherein said second adhesive comprises an acrylic adhesive.

3. The toner cartridge replacement seal assembly as set forth in claim 1 wherein said release liner seal member adhered to the substrate first face comprises multi-layer polyester film.

4. A method of fabricating a seal assembly for sealing a toner discharge opening defined in a toner cartridge, said method comprising:

cutting a section of double-sided tape to have a length and width at least minimally longer and wider, respectively, than the toner discharge opening, said tape section having a first face with a first adhesive thereon and a second face with a second adhesive thereon, wherein said first adhesive has less adhesion than the second adhesive and said first and second adhesives are covered by first and second release liners, respectively;

cutting an aperture in the section of double-sided tape that substantially corresponds in size and shape to the toner discharge opening;

removing said first release liner from said double-sided tape section to expose said first adhesive; and, adhering a release liner seal member to said first face using said first adhesive, said release liner seal member covering said first face and said aperture in the double-sided tape section, and including a leader extending therefrom.

5. The method of fabricating a seal assembly as set forth in claim 4 wherein said first adhesive comprises a silicon-based adhesive and said second adhesive comprises an acrylic-based adhesive.

6. The method of fabricating a seal assembly as set forth in claim 4 wherein said release liner seal member comprises multiple adjacent layers of polyester film.

7. The method of fabricating a seal assembly as set forth in claim 4 wherein said first and second release liners are different colors to facilitate distinction between said first and second faces of said double-sided tape section.

8. A method of resealing a toner cartridge toner discharge opening, said method comprising:

separating a magnetic roller housing from a toner hopper portion of the toner cartridge to expose said toner discharge opening in the toner hopper portion;

using a first adhesive, adhering a first face of a substrate to said toner hopper portion so that said substrate surrounds a periphery of said toner discharge opening, said substrate including an opening therein adapted for at least partial registration with said toner discharge opening when said substrate is adhered to said toner hopper portion;

using a second adhesive having lower adhesion than said first adhesive, adhering a release liner seal member to a second face of said substrate so that said release liner seal member at least substantially covers said substrate and sealingly engages said toner discharge opening, said release liner seal member having an elongated leader extending from a first end thereof;

folding said leader backwardly upon said release liner seal member so that a free end of said leader extends outwardly beyond a second end of said release liner and outwardly beyond an edge of said toner hopper portion; and re-connecting said magnetic roller housing to said toner hopper portion so that said free end of said leader extends outwardly from said toner cartridge through an opening between said toner hopper portion and said magnetic roller housing.

9. The method of resealing a toner cartridge as set forth in claim 8 wherein said first adhesive comprises a silicone-based adhesive and said second adhesive comprises an acrylic-based adhesive.

10. The method of resealing a toner cartridge as set forth in claim 8 wherein said release liner seal member comprises multi-layer polyester film.

11. A toner cartridge comprising:

a toner hopper including a toner discharge opening defined therein;

a magnetic roller housing connected to said toner hopper in spaced covering relation to said toner discharge opening; and, a seal assembly connected to said toner hopper and adapted for preventing passage of toner from an interior portion of said toner hopper through said toner discharge opening, said seal assembly comprising:

a substrate having a first surface and aperture therein, said first surface adhered to said toner hopper using a first adhesive so that said substrate surrounds a periphery of said toner discharge opening and said aperture is at least partially aligned with said toner discharge opening, and, a seal strip including a seal portion adhered to a second surface of said substrate using a second adhesive having lower adhesive strength than said first adhesive so that said seal portion sealingly covers said toner discharge opening in said hopper and said aperture in said substrate, said seal strip including a leader portion extending from said seal portion and folded backwardly upon said seal portion so that said leader portion extends outwardly from the toner cartridge between the toner hopper and the magnetic roller housing, whereby, when said leader is pulled to remove said seal strip from said second surface of said substrate, said substrate and said second adhesive remain in said toner cartridge.

12. The toner cartridge as set forth in claim 11 wherein said first adhesive comprises an acrylic adhesive and said second adhesive comprises a silicone adhesive.

13. The toner cartridge as set forth in claim 11 wherein said seal strip comprises multiple layers of polyester film.

14. The toner cartridge as set forth in claim 11 wherein said seal assembly has a maximum thickness of approximately 0.007 inches.

* * * * *